United States Patent [19]

Hamman

[11] 4,441,552

[45] Apr. 10, 1984

[54] HYDRAULIC SETTING TOOL WITH FLAPPER VALVE

[75] Inventor: Reed K. Hamman, Duncan, Okla.

[73] Assignee: Halliburton Company, Duncan, Okla.

[21] Appl. No.: 389,592

[22] Filed: Jun. 18, 1982

[51] Int. Cl.[3] ..... E21B 23/00; E21B 34/12

[52] U.S. Cl. ..... 166/133; 166/120; 166/152; 166/332

[58] Field of Search ..... 166/120, 133, 188, 123, 166/181, 126, 152, 63, 332, 212, 334

[56] References Cited

U.S. PATENT DOCUMENTS

| | | | |
|---|---|---|---|
| 3,122,205 | 2/1964 | Brown et al. | 166/120 |
| 3,298,437 | 1/1967 | Conrad | 166/123 |
| 3,299,955 | 1/1967 | Page, Jr. | 166/120 |
| 3,306,363 | 2/1967 | McZilkey, Jr. | 166/152 |
| 3,356,140 | 12/1967 | Young | 166/332 |
| 3,498,376 | 3/1970 | Sizer et al. | 166/120 |
| 3,556,220 | 1/1971 | Schwegman | 166/120 |
| 3,608,634 | 9/1971 | Cochran | 166/212 |
| 3,735,827 | 5/1973 | Berryman | 166/178 |
| 4,253,521 | 3/1981 | Savage | 166/123 |

*Primary Examiner*—James A. Leppink
*Assistant Examiner*—Hoang C. Dang
*Attorney, Agent, or Firm*—Joseph A. Walkowski; Thomas R. Weaver

[57] ABSTRACT

A hydraulic setting tool for use with a packer having expandable anchor means for anchoring the packer in a well bore, a conduit to permit flow through the packer, and a slidable valve positioned in the conduit having an open lower position and a closed upper position. Inner and outer tubular portions are telescopically interengaged with the inner portion receiving a slidable mandrel. The tool conduit is connected to the inner sleeve with a shearable tension collar, the mandrel passing through the collar and into the conduit for engagement with the valve. Annular pistons are provided between the inner and outer sleeves and between the mandrel and the inner sleeve. A flapper valve is pivotally attached on one side to the inner sleeve for sealing the top of the mandrel. Pressurization of the inner sleeve via tubing string from which the tool and the packer are suspended pressurizes the annular spaces beneath the pistons thus forcing the inner sleeve as well as the mandrel upwardly to set the tool. Such upward movement of the inner sleeve breaks a seal at the lower end thereof to permit depressurization of the annular space below the mandrel piston which forces the mandrel downwardly. A lock ring locks the mandrel in its lower position to permit further operation of the valve with the mandrel.

23 Claims, 6 Drawing Figures

HYDRAULIC SETTING TOOL WITH FLAPPER VALVE

BACKGROUND AND SUMMARY OF THE INVENTION

The instant invention relates to apparatus for setting a tool in a well bore and more particularly to such apparatus in which the setting of the tool is accomplished with hydraulic pressure.

The instant invention can be used to set in a well bore a packer of the type having a conduit therethrough and to thereafter selectively connect and disconnect a pipe or tubing string to the packer conduit. The packer is of the type having elastomeric material disposed about the conduit and further having upper and lower slip assemblies positioned above and beneath the packing material. The conduit includes a valve having an internal sliding sleeve which is selectively movable between one position permitting fluid flow through the conduit and another position shutting off such flow.

Past setting tools have been proposed for setting such packers. One past tool includes a mandrel for insertion into the packer conduit for opening and closing the sleeve valve, an inner sleeve which supports the mandrel and connects it to the conduit string, and a screw jack device disposed between the inner sleeve and an outer setting sleeve.

In setting the above-described packer with the prior art tool, a string is made up wherein the setting tool is connected by its inner sleeve to a tubing string, a breakable tension sleeve is threadably engaged between the lower end of the inner sleeve and the upper end of the packer conduit, and the setting tool mandrel extends into the packer conduit to maintain the slidable valve in an open position while the tubing string is lowered into the well. When the desired depth for setting the packer in the casing is reached, the tubing string is rotated a predetermined number of times, which rotation operates the screw jack device, thus forcing the setting sleeve downwardly to set the upper packer slips against the sides of the bore. Tension is applied with the tubing to set the lower slips and break the tension sleeve. This leaves the packer engaged in the bore and the setting tool suspended on the tubing string thereabove. Thereafter, the mandrel may be stung into the packer conduit for actuating the valve to provide fluid communication between the tubing string and the bore beneath the packer.

Such past setting tools have proved somewhat unsatisfactory due to their mechanical complexity as well as the necessity for substantial amounts of vertical and rotational movement of the pipe or tubing string and loading of the string in order to set the packer.

Past apparatus have been proposed for setting liner hangers in which hydraulic pressure is used to effect setting. One such apparatus includes an annular collar disposed about a mandrel which is suspended from a tubing string. A ball is dropped down the tubing string to seal the string beneath the collar. A port connects the tubing string to the annulus between the collar and the mandrel and when the string is pressurized, the collar moves upwardly. Setting slips disposed on an inclined surface are suspended from the collar and upward movement along the surface urges the slip outwardly to set the hanger. Such past liner hangers are not adaptable for setting packers of the type above described and do not include a mandrel for actuation of the sliding packer valve.

The instant invention includes inner and outer sleeves telescopically interengaged and adapted to be suspended from a pipe or tubing string for lowering into a well bore. The shearable tension sleeve connects a packer of the above-described type to the lower end of the inner sleeve. A vertically shiftable mandrel is received within the inner sleeve for engaging the packer valve. Piston means are disposed between the inner and outer sleeves and between the mandrel and the inner sleeve. Pressurization of the tubing acts on the piston means to effect upward movement of the inner sleeve and of the mandrel. Such pressurization seals the top of the mandrel from the tubing string by means of a flapper valve. When the inner sleeve assumes a predetermined position with respect to the outer sleeve, pressure beneath the mandrel piston means is released thus permitting downward mandrel movement with respect to the inner sleeve. Mandrel lock means locks the mandrel to the inner sleeve to permit selective actuation of the packer valve by raising and lowering the tubing string.

DETAILED DESCRIPTION OF THE INVENTION

Figure 1A:
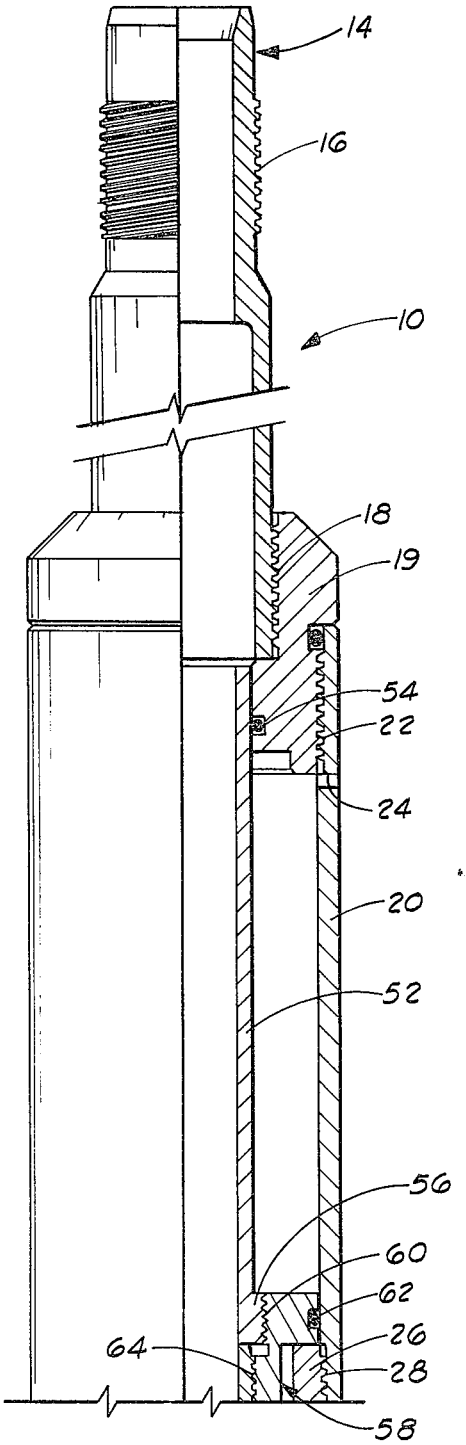
FIGS. 1A—1F are successive downward continuations, shown partly in quarter-section and partly in half-section, of a setting tool incorporating the apparatus of the present invention combined with a packer.

Turning now to the drawings, indicated generally at 10 is a setting tool constructed in accordance with the present invention. A well tool or packer 12 is mounted on the lower end of the setting tool. An adapter mandrel 14 is substantially cylindrically shaped and includes threads 16 for threadably engaging the setting tool and packer combination to an adapter of a tubing string (although a string of drill pipe will work equally well) for lowering into a well bore. As will be explained in detail herein, setting tool 10 is constructed to set packer 12 in a well bore responsive to pressurization of the tubing string. Thereafter, the tool may be lowered onto the packer, as desired, to provide fluid communication between the well bore beneath the packer and the tubing string.

Adapter mandrel 14 includes a second set of threads 18 at the lower end thereof. Threads 18 are threadably engaged with internal threads on a coupling 19. The coupling 19 connects adapter 14 to a cylindrically shaped piston case 20 via threads 22. The piston case includes a bore 24 which permits fluid communication between the interior and the exterior of the case. The lower end of the piston case is threadably engaged to an upper annular joining nipple 26 via threads 28. The joining nipple includes a radially outer surface 30 and a radially inner surface 32. An annular ring 34 is formed about the circumference of surface 32. An O-ring 35 provides a sealing surface about the radial inner side of ring 34. O-rings 36, 38 provide a fluid-tight seal between the juncture of nipple 26 with piston case 20 and between the juncture of the nipple with a lower piston case 40, respectively. The lower piston case is joined to nipple 26 via threads 42. Piston case 40 is substantially identical to piston case 20 and includes a bore 44 like bore 24 in piston case 20.

The lower end of piston case 40 is threadably engaged via threads 46 with a lower annular joining nipple 48. Nipple 48 is substantially identical to joining nipple 26 and includes an annular ring 50 like ring 34 in nipple 26.

Adapter mandrel 14, coupling 19, piston case 20, joining nipple 26, piston case 40, and joining nipple 48, all comprise the upper portion of what is referred to herein as a first tubular portion. These components provide a generally cylindrical outer sleeve which is attached via adapter mandrel 14 to the tubing string adapter.

Description will now be made of components which make up the upper part of what is referred to herein as a second tubular portion. The second tubular portion includes an upper sleeve 52, such being cylindrically shaped and further being in sealing engagement, via an O-ring 54, with the lower radially inner surface of coupling 19. The lower end of upper sleeve 52 includes a widened diameter portion 56 such being in threaded engagement with an upper piston 58 via threads 60.

The upper piston is generally annularly shaped and includes an O-ring 62 for sealing the radially outer surface of the piston to the radially inner surface of piston case 20. Threads 64 formed about the lower portion of upper piston 58 engage the piston to a middle sleeve 66.

The middle sleeve includes a bore 68. Bore 68 provides fluid communication between the interior of middle sleeve 66 and an annular chamber 69 formed between upper joining nipple 26 and upper piston 58. A set screw 70 is received within a threaded bore in upper piston 58 and abuts against the radially outer surface of middle sleeve 66 to fix the position of the upper piston with respect to the middle sleeve.

Middle sleeve 66 includes at its lower end a widened diameter portion 72 including threads 74 for engaging a lower piston 76.

The lower piston is substantially identical to piston 58. The lower piston is threadably engaged via threads 78 to a lower sleeve 80. The upper and lower pistons are referred to herein as piston means. Lower sleeve 80 includes a bore 82 formed between its interior and exterior surfaces. Bore 82 provides fluid communication between the interior of sleeve 80 (and hence the tubing string connected to adapter mandrel 14) and an annular chamber 84 formed between lower nipple 48 and lower piston 76.

Lower joining nipple 48 is threadably engaged via threads 86 with a substantially cylindrical setting sleeve body 88. The setting sleeve body includes a bore 90 between its interior and exterior, such being formed beneath threads 86. Setting sleeve 88 also includes an annular ridge 92 formed about the radially inner surface of the setting sleeve body. The annular ridge includes a substantially cylindrical surface 94 formed at the top of the ridge about the circumference thereof. The lower end of setting sleeve body 88 includes threads 96 and an O-ring 98 for sealingly connecting the setting sleeve body to a substantially cylindrical setting sleeve 100. A set screw 102 is received within a threaded bore formed through the setting sleeve body beneath threads 96. The set screw abuts against the radially outer surface of setting sleeve 100 to fix the relative positions of the setting sleeve body and the setting sleeve.

Setting sleeve 100 includes an annular chamfer 104 formed about the circumference of the setting sleeve at its lower end. Chamfer 104 is referred to herein as anchor engagement means.

Figure 1B:
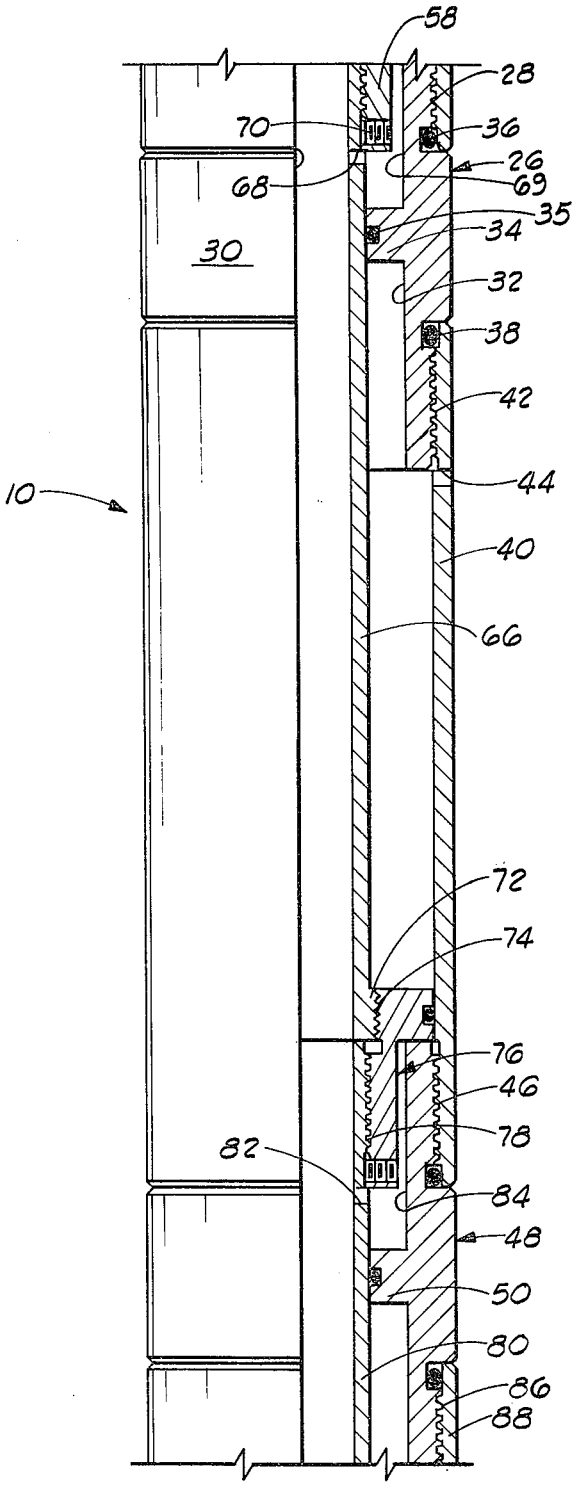

The above-described upper portion of the first tubular assembly (shown in FIGS. 1A and 1B) continues downwardly to include setting sleeve body 88 and setting sleeve 100. Thus, the first tubular portion, beginning with coupling 19 and upper piston case 20 and extending downwardly to setting sleeve 100, is substantially cylindrical and is fixedly mounted on the tubing string (not shown) via adapter mandrel 14.

Figure 1C:
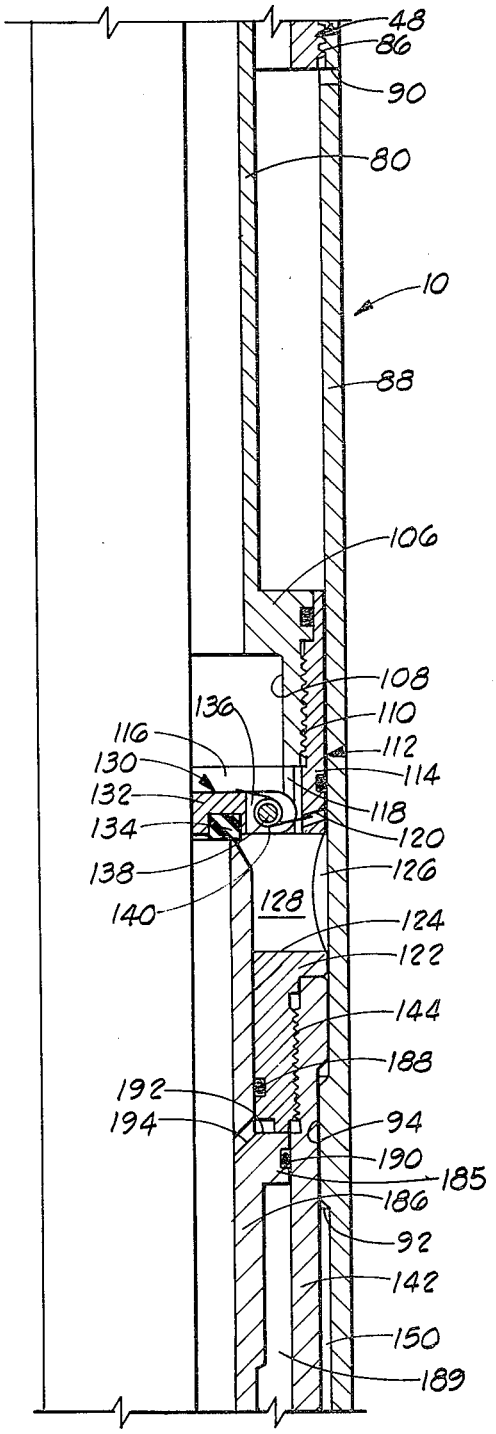

What is referred to herein as a second tubular portion includes at its upper end, upper sleeve 52 and extends downwardly to include middle sleeve 66 and lower sleeve 80. Continuing the description of the second tubular portion, in FIG. 1C, the lower end of lower sleeve 80 includes a widened diameter portion 106. Portion 106 includes a counterbore 108 which provides fluid communication between the interior of sleeve 80 and its exterior at the lower end thereof. Threads 110 provide threaded engagement between portion 106 of the lower sleeve and a flapper valve housing 112.

The flapper valve housing includes an annular upper portion 114. Portion 114 includes a circular bore 116, such being of the same diameter as counterbore 108 and communicating therewith. A vertical slot 118 is formed on one side of bore 116. A bore 120 is formed between slot 118 and the radially outer surface of upper portion 114. A lower annular portion 122 of flapper valve housing 112 includes a circular bore 124 which permits fluid communication between a radially inner portion 126 of setting sleeve body 88 and the interior of the flapper valve housing. The surface of bore 124 is denoted by numeral 128.

A flapper valve 130 includes a circular valve body 132. An annular seal 134 is mounted on the lower side of valve body 132. A mounting tab 136 extends from the rear end of valve body 132 and is received within slot 118. The mounting tab includes a hole through which a post 138 extends. Post 138 is fixedly received within bores (not shown) formed on either side of circular bore 116. Thus, flapper valve 130 pivots about post 138. A spring 140 biases the flapper valve downwardly.

A mandrel case 142 is substantially cylindrically shaped and is threadably engaged with the lower end of the flapper valve housing via threads 144. Mandrel case 142 includes an annular channel 146 formed in the radially outer surface of the mandrel case about its circumference. An O-ring 148 is received within the channel. An annular space 150 is formed between mandrel case 142 and setting sleeve body 88. Another annular space 152 is formed between the mandrel case and setting sleeve 100. Spaces 150, 152 are in fluid communication with each other. The lower end of mandrel case 142 includes a counterbore 154. The lower end is threadably engaged via threads 156 to a lock ring housing 158.

The lock ring housing is of annular shape and includes an annular upward facing shoulder 160 about the interior of the housing. An annular space 162 is formed between the radially outer surface of lock ring housing 158 and the radially inner surface of setting sleeve 100. An O-ring 164, also referred to herein as sealing means, provides a seal between the lock ring housing and the radially inner surface of the setting sleeve at the lower end of space 162. A bore 166 provides fluid communication between space 162 and the interior of lock ring housing 158.

A lock ring 168, also referred to herein as mandrel lock means, includes a plurality of arcuate segments, one of which is segment 170. The segments are constrained from vertical movement between the lower end of mandrel case 142 and shoulder 160 on the lock ring housing. The segments are all biased radially inwardly by an O-ring 172 disposed about the radially outer side of the segments.

A coupling ring support 174 is generally cylindrically shaped and is threadably engaged via threads 176 to the lower end of lock ring housing 158. Support 174 includes an annular upper end 159. The coupling ring support includes an upward facing shoulder 178 for maintaining a coupling ring 180 between shoulder 178 and the lower end of lock ring housing 158. The coupling ring is attached to a generally cylindrically shaped tension sleeve 182, also referred to herein as shearable means, via threads 183.

Figure 1D:
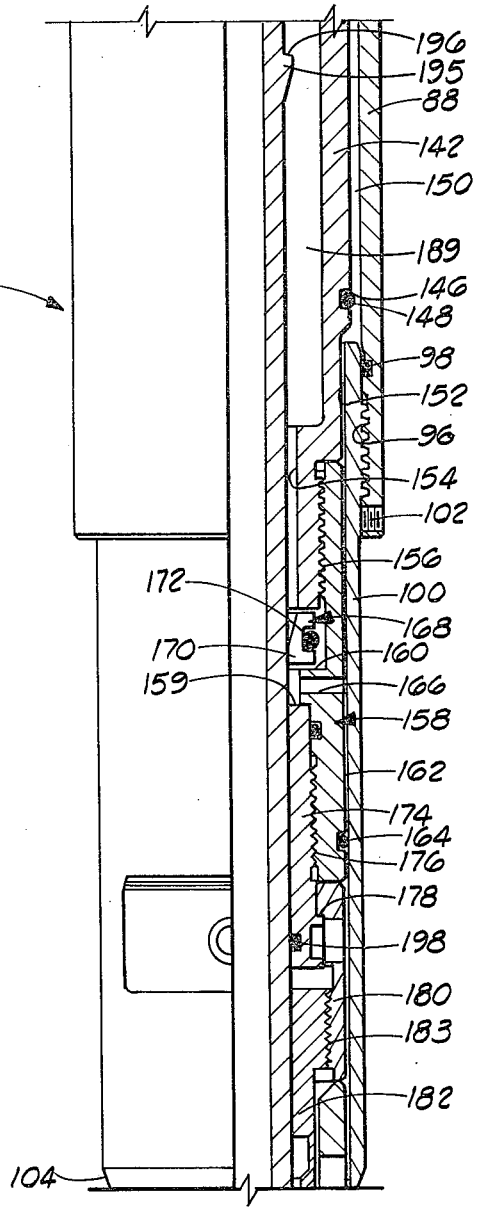

Tension sleeve 182 provides a connection between setting tool 10 and packer 12. The lower end of tension sleeve 182 is threadably engaged to a generally cylindrical conduit or packer mandrel 184 substantially contained within the packer. The setting tool includes a mandrel 186, which extends from just beneath flapper valve 130 into packer mandrel 184. The mandrel is generally cylindrically shaped and has its top end sealed against annular seal 134 of the flapper valve. An O-ring 188 provides sealing engagement between the radially outer surface of the mandrel and the radially inner surface of flapper valve housing 112. An annular piston or collar 185 is formed about the radially outer circumference of the mandrel. A second O-ring 190 seals the collar between its radially outer surface and the radially inner surface of mandrel case 142. An annular hydraulic chamber 189 is formed beneath collar 185. The top of collar 185 includes an upward facing annular shoulder 192. A bore 194 is formed through the mandrel to provide fluid communication between the mandrel interior and exterior. The mandrel includes an annular portion 195 having an upward facing shoulder 196 in FIG. 1D. Shoulder 196 is annular in shape and is formed about the circumference of the mandrel. An O-ring 198 seals the mandrel about its circumference between the radially outer surface of the mandrel and the radially inner surface of coupling ring support 174. At its lower end, mandrel 186 includes a reduced diameter portion 200 and at the very lower end of the mandrel, an annular chamfer 202.

Figure 1E:
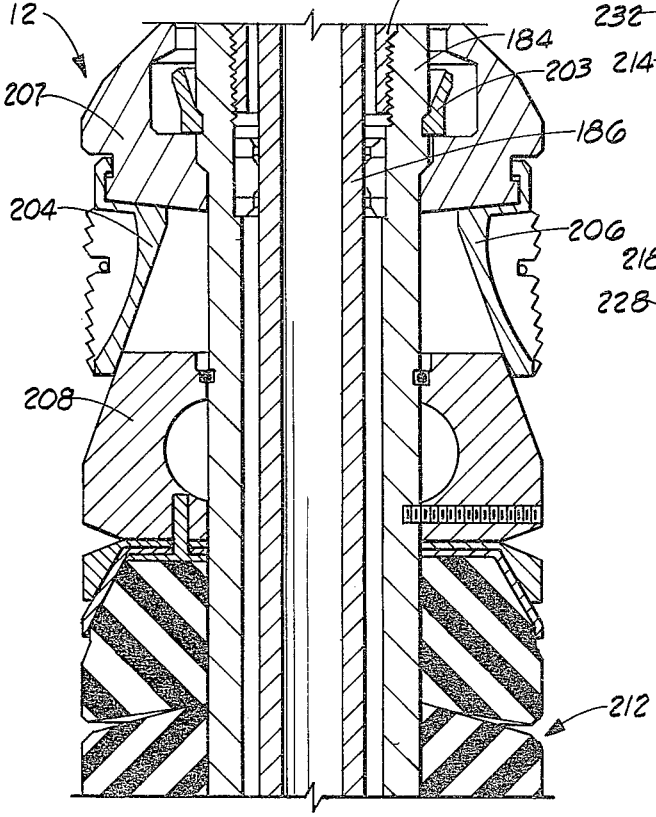

Packer 12 includes a conventional split ring 203 which, in the condition shown in FIG. 1E, maintains slips 204, 206 in an upper position as shown. Slips such as slips 204, 206 are suspended from an annular lock ring housing 207. A conventional wedge 208 is provided to force slips 204, 206, respectively, outward as the slips move downward relative to the wedges. Elastomeric packers 212 are confined about packer mandrel 184 between upper wedge 208 and a lower wedge 214. The lower wedge coacts with slips such as lower slips 218, 220 in a conventional manner to force the slips outwardly to engage the sides of the well bore.

Figure 1F:
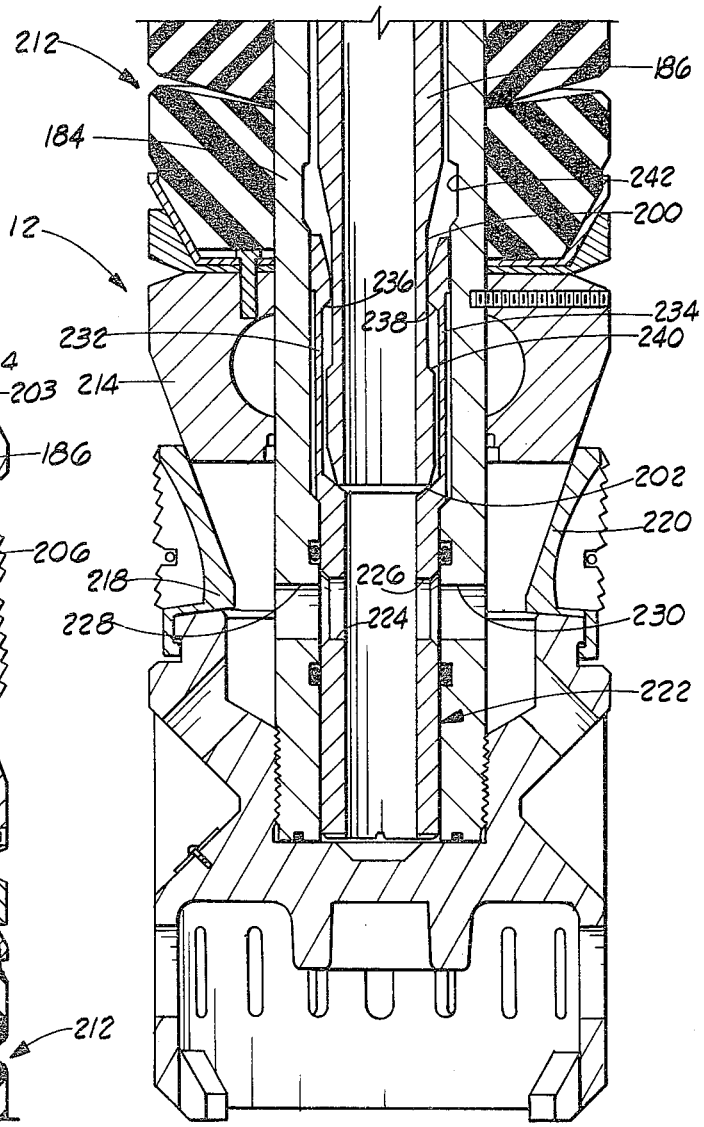

A cylindrical sliding valve sleeve 222 is closely received within the lower end of packer mandrel 184. The valve sleeve includes a pair of ports 224, 226 which, when the valve sleeve is in its lowermost position as shown, are aligned with a pair of ports 228, 230 in packer mandrel 184. Valve sleeve 222 includes upwardly extending fingers 232, 234 which, in the condition shown in FIG. 1F, are engaged against reduced diameter portion 200 of mandrel 186. Fingers such as fingers 232, 234 include interior downward directed shoulders 236, 238 formed on the upper portion thereof. A lower annular shoulder 240 on mandrel 186 defines the lower end of reduced diameter portion 200. An annular groove 242 is formed about the radially inner surface of packer mandrel 184 above fingers 232, 234.

In operation, tool 10 and packer 12 are connected to a tubing string via adapter mandrel 14 at the surface of a well bore. The tool and the packer are in the configuration as shown in FIGS. 1A—1F. Mandrel 186 is in its upper position having shoulder 192 abutted against the lower end of flapper valve housing 112. The lower end of the flapper valve housing prevents the mandrel from moving any further upwardly. Annular shoulder 202 at the lower end of mandrel 186 is pressed against sliding valve 222 to maintain the valve in its lowermost position thus aligning ports 228, 224 and ports 226, 230 to permit fluid communication between the well bore and the mandrel. Upper slips 204, 206 and lower slips 218, 220 are maintained in their radially innermost position as shown in FIGS. 1E and 1F.

As the tubing string is lowered into the well bore, fluid enters the packer and setting tool via ports 224, 228 and ports 226, 230. The fluid fills mandrel 186 and forces flapper valve 130 upwardly off the top of the stinger to permit filling of the tubing.

When the depth is reached at which it is desired to set the packer in the well bore, lowering of the tubing is stopped. At this point, the fluid in the tubing is pressurized by applying pump pressure to the tubing at the top of the well bore. As the fluid pressure in the tubing increases, fluid is pumped into chambers 69, 84 via bores 68, 82, respectively. As the pressure in the chambers increases, fluid pressure acting upwardly on upper piston 58 and on lower piston 76 causes upward movement of the second tubular portion, such including upper sleeve 52, middle sleeve 66, lower sleeve 80, flapper valve housing 112, mandrel case 142, lock ring housing 158, coupling ring support 174, and coupling ring 180. It is noted that upward movement of coupling ring 180 likewise moves tension ring 182 upwardly and hence the packer, to which the tension ring is attached. As application of fluid pressure continues, the packer moves upwardly so that chamfer 104 on the lower end of setting sleeve 100 engages lock ring 203 on the packer. Chamfer 104 descends into the radially inner side of the lock ring, thus causing spreading of the ring to permit the setting sleeve to push lock ring housing 207 and hence slips 204, 206 downwardly. Such downward motion causes engagement of slips 204, 206 with the side of the well bore. Continued upward movement of the second tubular portion pulls lower slips 218, 220 over lower wedge 214, thus forcing lower slips 218, 220 outwardly into engagement with the sides of the well bore. Packer 12 is at this point set in the well bore.

During such upward movement of the second or inner tubular portion, mandrel 186 is maintained in its upper position by fluid pressure from the tubing communicated to hydraulic chamber 189 beneath mandrel collar 185 as follows: fluid flows from the tubing through inner sleeve 80, counterbore 108, slot 118 and bore 124 to the annular space between lower portion 122 of the flapper valve housing and setting sleeve body 88. From there, fluid passes downwardly to annular space 150 since there are no O-rings or other seals to prevent transmission of fluid pressure from bore 124 to annular space 150. As will be recalled, annular space 150 communicates with space 152 which in turn communicates with annular space 162. Bore 166 permits pressure transmission to the interior of the lock ring housing and from thence upwardly through counterbore 154 into hydraulic chamber 189. It will be seen that when the hydraulic chamber is pressurized, such pressure acts to force mandrel collar 185 upwardly to maintain it against the lower part of flapper valve housing 112.

Continued pressurization after setting of the upper and lower slips causes further upward movement of the second tubular portion and mandrel 186. It can be seen that the interior of mandrel 186 is not pressurized due to the sealing of the flapper valve over the top of the mandrel. Continued pressurization ultimately breaks tension sleeve 182 thus separating the tool from the packer. During upward movement of the second tubular portion and of mandrel 186, sliding valve 222 is lifted upwardly when shoulder 240 on the mandrel engages shoulders 236, 238 on the valve fingers and lifts the valve upwardly until the upper portion of the fingers are received within annular groove 242, thus locking the valve in its upper closed position. Continued upward movement of mandrel 186 lifts the mandrel away from the fingers leaving the valve locked in its closed position.

As mandrel case 142 moves upwardly, O-ring 148 ultimately seals against surface 94 on ridge 92. Thus, the pressurized fluid in hydraulic chamber 189 is sealed off from the pressurized fluid in the tubing. Immediately after sealing of O-ring 148 against surface 94, continued pressurization of the tubing string lifts the first tubular portion enough to raise seal 164 above the top of setting sleeve 100. This breaks the seal between the pressurized fluid in hydraulic chamber 189 and the fluid in the well bore. The pressurized fluid in the hydraulic chamber passes from the chamber through bore 166 and annular space 162 into the bore fluid (since O-ring 164 is no longer sealingly engaged against the radially inner surface of setting sleeve 100).

Such depressurization of the hydraulic chamber permits downward movement of mandrel 186. The pressurized fluid in the tubing (and in counterbore 108) applies downward pressure to the top of flapper valve 130. Once hydraulic chamber 189 is depressurized, the downward acting pressure on the flapper valve causes mandrel 186 to begin downward movement. Once the seal between the top of the mandrel and seal 134 in the flapper valve is broken, pressurized fluid from the tubing may enter mandrel 186. When such fluid enters the mandrel, it is transmitted via bore 194 to the annular space above mandrel collar 185 thus further forcing the mandrel downwardly. Downward movement of the mandrel continues until shoulder 196 passes locking ring 170. Further downward movement of the mandrel is prevented by engagement of annular portion 195 with shoulder 159. Lock ring 168 acting against shoulder 196 prevents upward movement of the stinger. Thus, the mandrel is substantially locked in its lower position.

As mandrel 186 moves downwardly, chamfer 202 at the lower end of the mandrel abuts against sliding valve 222 to move it from its upper closed position back to its lower open position as shown in FIG. 1F. Thus, the packer is set in the well, the tension sleeve connecting the packer to tool 10 is broken, mandrel 186 is locked in its lower position, and sliding valve 222 is in its lowermost open position. Operations as desired may proceed, e.g., fluid may be withdrawn from the bore beneath the packer and/or fluid injected into the bore beneath the packer. Thereafter, if it is desired to seal off the bore beneath the packer, the tubing string is raised thus lifting mandrel 186 and hence moving sliding valve 222 to its upper closed position. If it is desired to again open the valve, the tubing string may again be lowered thus abutting the lower end of mandrel 186 against the sliding valve to open it for further operations.

It is to be appreciated that additions and/or modifications to the preferred embodiment disclosed herein may be made without departing from the spirit of the invention as defined in the following claims.

I claim:

1. A hydraulic setting apparatus for use on the lower end of a tubing string for anchoring a well tool in a well bore responsive to pressurization of said tubing string, said tool being of the type having expandable anchor means for anchoring the tool in said well bore and a conduit for selectively permitting fluid flow through the tool, said apparatus comprising:

first and second tubular portions in telescopic engagement with each other, said first tubular portion being constructed for mounting on the tubing string and said second tubular portion being longitudinally slidable within said first portion;

means for mounting said portions on the end of the tubing string;

piston means disposed between said tubular portions for telescopically moving said portions relative to one another responsive to pressurization of the tubing string;

means for suspending such a tool mounted on the lower end of said tubular portions;

a mandrel received within said portions and being slidable between upper and lower positions; and fluid pressure means mounted on said mandrel for maintaining said mandrel in its upper position.

2. The apparatus of claim 1 wherein said suspending means includes shearable means mounted on the lower end of said second tubular portion.

3. The apparatus of claim 2 wherein said apparatus further includes anchor engagement means mounted on the lower end of said first tubular portion for engagement with such expandable anchor means, said engagement means expanding said anchoring means when so engaged.

4. The apparatus of claim 1 wherein said mandrel is received within said second tubular portion and wherein said fluid pressure means includes mandrel piston means formed between said mandrel and said second tubular portion and a hydraulic chamber formed between said mandrel piston means and the lower end of said second tubular portion.

5. The apparatus of claim 4 wherein said fluid pressure means further includes sealing means formed at the lower end of said chamber between said first and second tubular portions, said sealing means forming a fluid seal between said portions with said second portion being below a predetermined position with respect to said first portion and breaking said seal when said second portion is above said position.

6. The apparatus of claim 1 wherein said mandrel includes a longitudinal bore therethrough and said apparatus further includes flapper valve means for sealing the top of said mandrel.

7. The apparatus of claim 6 wherein said fluid pressure means includes mandrel piston means formed about said mandrel and a chamber positioned therebeneath and wherein said apparatus further includes conduit means disposed between the interior of said second portion above said flapper valve means and said chamber for permitting fluid communication therebetween.

8. The apparatus of claim 1 wherein said apparatus further includes mandrel lock means for locking said mandrel to said second tubular portion when said mandrel and said second portion assume a predetermined relative longitudinal position to each other.

9. Setting apparatus of the type having a mandrel extending downwardly therefrom for anchoring in a well bore a tool having expandable anchor means and a central conduit including a slidable conduit valve for selectively permitting fluid flow through the conduit, said apparatus, in condition for setting such a tool comprising:

a first tubular portion;

a second tubular portion telescopically received within said first tubular portion;

a coupling mounted on the top of said first tubular portion, said coupling rigidly connecting said first portion to a string of tubing;

piston means disposed between said portions, said piston means forcing said second portion upwardly responsive to pressurization of the tubing; and shearable means mounted on the lower end of said second portion, said shearable means supporting the tool therefrom;

said mandrel being slidably engaged within said second portion and extending into the tool conduit to maintain said slidable valve in a fluid-flow condition.

10. The apparatus of claim 9 wherein said apparatus further includes anchor engagement means mounted on the lower end of said first tubular portion for engagement with the expandable anchor means on the tool, such engagement causing expansion of the anchor means and anchoring of the tool.

11. The apparatus of claim 9 wherein said apparatus further includes means for limiting the upper and lower position of said mandrel relative to said second tubular portion.

12. The apparatus of claim 11 wherein said mandrel includes a longitudinal bore therethrough and said apparatus further includes mandrel piston means mounted on said mandrel and flapper valve means pivotally mounted on said second tubular portion for covering and sealing the top of said mandrel.

13. The apparatus of claim 12 wherein said apparatus further includes conduit means disposed between said second tubular portion above said flapper valve and the exterior of said mandrel beneath said mandrel piston means so that pressurization of the tubing urges said mandrel upwardly to its upper limit and urges said flapper valve means downwardly for sealing the mandrel interior from the tubing.

14. The apparatus of claim 13 wherein said apparatus further includes a bore formed in said mandrel to permit fluid communication between said mandrel and the exterior of said mandrel above said mandrel piston means.

15. The apparatus of claim 14 which further includes sealing means formed between said first and second portions at the lower end of said first portion for providing fluid communication between the area beneath said mandrel piston means and the well bore when said second tubular portion reaches a predetermined longitudinal position with respect to said first tubular portion.

16. The apparatus of claim 9 wherein said apparatus further includes means for locking said mandrel to said second tubular portion when said mandrel assumes a predetermined longitudinal position relative to said second tubular portion.

17. A hydraulic setting tool for use with a packer having expandable anchor means for anchoring the packer in a well bore, a conduit to permit flow through the packer, and a slidable valve positioned in the conduit having an open lower position and a closed upper position, said tool, in condition for setting such a packer, comprising:

a first tubular portion mounted on a tubing string for lowering into the well bore;

a second tubular portion slidably received within said first tubular portion;

a mandrel having a longitudinal bore therethrough, said mandrel being slidably received within said second tubular portion and extending into the packer conduit and engaging the valve to maintain it in an open position;

mandrel piston means mounted about the circumference of said mandrel in sealing engagement with said second tubular portion;

sealing means mounted between said first and second tubular portions at the lower ends thereof and forming a chamber between said mandrel piston means and said sealing means;

valve means associated with the upper end of said mandrel for providing a seal between said mandrel bore and the tubing; and conduit means for communicating tubing pressure to said chamber for maintaining said mandrel in an upper position so that upward movement of said second tubular portion closes the slidable valve.

18. In an apparatus for setting a well tool in a well bore, said apparatus being of the type having inner and outer sleeves telescopically interengaged and a vertically shiftable mandrel having a longitudinal bore therethrough, said mandrel being received within said inner sleeve, a device for maintaining said mandrel in a predetermined longitudinal position with respect to said inner sleeve, said device comprising:

mandrel piston means mounted on the outer surface of said mandrel;

means forming a hydraulic chamber beneath said mandrel piston means;

flapper valve means for sealing the mandrel bore from the inner sleeve; and conduit means for permitting fluid communication between the inner sleeve and said hydraulic chamber.

19. The device of claim 18 wherein said mandrel piston means includes an annular collar mounted about the circumference of said mandrel and means for sealing said collar to the inner surface of said sleeve.

20. The device of claim 18 wherein said flapper valve means includes a flapper valve pivotally mounted on one side to the inner sleeve and biasing means for biasing said flapper valve into sealing engagement with the mandrel bore.

21. The device of claim 18 wherein said device further includes a bore formed in said mandrel to permit fluid communication between said mandrel and the exterior of said mandrel above said mandrel piston means.

22. The device of claim 18 wherein said means forming a hydraulic chamber includes a seal formed between said inner and outer sleeves and means for breaking said seal to permit fluid communication between the chamber and the well bore when said inner and outer sleeves assume a predetermined longitudinal relative position.

23. The device of claim 18 wherein said device further includes mandrel lock means disposed between the mandrel and said inner sleeve for locking said mandrel to said inner sleeve to prohibit substantially all relative longitudinal movement when the inner sleeve and the mandrel assume a predetermined longitudinal relative position.

* * * * *